US012484661B2

(12) United States Patent
Evans

(10) Patent No.: US 12,484,661 B2
(45) Date of Patent: Dec. 2, 2025

(54) ANTI-SLIP SHOE STRAPS

(71) Applicant: Hernandez Cortez Evans, Brooklyn Park, MN (US)

(72) Inventor: Hernandez Cortez Evans, Brooklyn Park, MN (US)

( * ) Notice: Subject to any disclaimer, the term of this patent is extended or adjusted under 35 U.S.C. 154(b) by 603 days.

(21) Appl. No.: 17/227,638

(22) Filed: Apr. 12, 2021

(65) Prior Publication Data

US 2021/0315321 A1 Oct. 14, 2021

Related U.S. Application Data

(60) Provisional application No. 63/008,129, filed on Apr. 10, 2020.

(51) Int. Cl.

| | |
|---|---|
| ***A43B 13/22*** | (2006.01) |
| ***A43B 3/16*** | (2022.01) |
| ***A43B 3/20*** | (2022.01) |
| ***A43C 15/04*** | (2006.01) |
| ***A43C 15/12*** | (2006.01) |

(52) U.S. Cl.

CPC ..... *A43B 13/22* (2013.01); *A43B 3/16* (2013.01); *A43B 3/20* (2013.01); *A43B 13/223* (2013.01); *A43C 15/04* (2013.01); *A43C 15/12* (2013.01)

(58) Field of Classification Search

CPC .. A43B 3/16; A43B 3/20; A43B 13/22; A43B 13/223; A43C 15/00; A43C 15/02; A43C 15/04; A43C 15/12; A43C 19/00; A41F 9/00; A41F 9/002

USPC ..... 36/62

See application file for complete search history.

(56) References Cited

U.S. PATENT DOCUMENTS

| | | | | |
|---|---|---|---|---|
| 1,117,019 | A | 11/1914 | Foltz | |
| 1,187,778 | A | 6/1916 | Paskett | |
| 2,668,373 | A | 2/1954 | Russo | |
| 2,932,096 | A | 4/1960 | Tavormina | |
| 3,021,617 | A | 2/1962 | Koch | |
| 3,258,863 | A * | 7/1966 | Paget | A43B 5/08 36/62 |
| 3,501,774 | A * | 3/1970 | Norman | A41F 11/16 24/306 |
| 4,005,533 | A | 2/1977 | Anderson et al. | |
| 5,315,768 | A | 5/1994 | Pacheco | |
| 5,463,823 | A | 11/1995 | Bell et al. | |
| 5,485,687 | A * | 1/1996 | Rohde | A43C 15/02 36/7.7 |
| 5,694,704 | A | 12/1997 | Kasbrick | |
| 5,813,143 | A | 9/1998 | Bell et al. | |

(Continued)

FOREIGN PATENT DOCUMENTS

| | | | | |
|---|---|---|---|---|
| DE | 29917659 U1 * | 1/2000 | | A43C 15/063 |
| WO | WO-2008012825 A2 * | 1/2008 | | A43B 3/16 |

(Continued)

*Primary Examiner* — Khoa D Huynh
*Assistant Examiner* — Giao QT Hoang

(57) ABSTRACT

An anti-slip strap for removably coupling and at least partially covering a shoe is disclosed. The anti-slip strap includes a base strap comprising woven synthetic fibers, a first set of protrusions coupled to the base strap and spaced from each other to create a first set of channels therethrough, and a second set of protrusions coupled to the base strap and spaced from each other to create a second set of channels therethrough.

14 Claims, 6 Drawing Sheets

(56) References Cited

U.S. PATENT DOCUMENTS

| | | | | |
|---|---|---|---|---|
| 5,966,840 | A * | 10/1999 | Bell | A43C 15/02 36/7.1 R |
| 7,383,646 | B2 | 6/2008 | Hall | |
| 7,784,611 | B2 | 8/2010 | Gordon | |
| 7,845,094 | B1 | 12/2010 | Gaskins, Jr. | |
| 8,215,030 | B2 | 7/2012 | Bowen et al. | |
| D737,549 | S | 9/2015 | House | |
| D737,550 | S | 9/2015 | House | |
| D737,551 | S | 9/2015 | House | |
| D739,123 | S | 9/2015 | House | |
| D739,647 | S | 9/2015 | House | |
| 9,173,447 | B2 | 11/2015 | Boakye | |
| 9,596,904 | B2 * | 3/2017 | Bishop | A43B 23/0245 |
| 9,918,513 | B2 | 3/2018 | Vakili | |
| 9,918,518 | B2 | 3/2018 | Chouinard | |
| 2005/0132614 | A1 * | 6/2005 | Brennan | A43B 13/36 36/73 |
| 2006/0026779 | A1 | 2/2006 | Berg et al. | |
| 2008/0022555 | A1 | 1/2008 | Mor et al. | |
| 2008/0235985 | A1 | 10/2008 | Gordon | |
| 2009/0241369 | A1 | 10/2009 | Votolato | |
| 2010/0299967 | A1 * | 12/2010 | Atsumi | A43B 5/02 36/133 |
| 2012/0167278 | A1 | 7/2012 | House | |
| 2012/0210600 | A1 | 8/2012 | Joubert et al. | |
| 2013/0042503 | A1 * | 2/2013 | Larson | A43C 15/066 12/142 T |
| 2013/0312294 | A1 * | 11/2013 | Tang | A43C 15/12 36/59 R |
| 2014/0295140 | A1 | 10/2014 | King et al. | |
| 2015/0181983 | A1 * | 7/2015 | Fox | A43B 23/25 63/3 |
| 2017/0172256 | A1 * | 6/2017 | Ganci | A43C 11/1493 |
| 2017/0196297 | A1 | 7/2017 | Chung | |
| 2018/0206590 | A1 * | 7/2018 | Amos | A43B 13/223 |
| 2018/0352906 | A1 * | 12/2018 | Miller | A43C 15/00 |
| 2019/0142110 | A1 | 5/2019 | Cruz et al. | |
| 2019/0335847 | A1 | 11/2019 | Soderqvist | |
| 2020/0229531 | A1 * | 7/2020 | Driscoll | A43B 3/122 |

FOREIGN PATENT DOCUMENTS

| | | | |
|---|---|---|---|
| WO | 2016040840 | A1 | 3/2016 |
| WO | 2018081518 | A1 | 5/2018 |

* cited by examiner

ANTI-SLIP SHOE STRAPS

CROSS-REFERENCE TO RELATED APPLICATION

This application claims priority to Provisional Application No. 63/008,129, filed Apr. 10, 2020, which is herein incorporated by reference in its entirety.

SUMMARY

In Example 1, an anti-slip strap for removably coupling and at least partially covering a shoe is disclosed. The anti-slip strap includes a base strap comprising woven synthetic fibers, a first set of protrusions coupled to the base strap and spaced from each other to create a first set of channels therethrough, and a second set of protrusions coupled to the base strap and spaced from each other to create a second set of channels therethrough.

In Example 2, the anti-slip strap of Example 1, wherein the first and the second set of protrusions are stitched to the base strap.

In Example 3, the anti-slip strap of any of the preceding Examples, wherein the first set of protrusions are spaced from the second set of protrusions without any other protrusions spaced therebetween.

In Example 4, the anti-slip strap of any of the preceding Examples, wherein the first and the second set of protrusions are coupled to the base strap on the same side of the base strap.

In Example 5, the anti-slip strap of any of the preceding Examples, wherein the first and the second set of protrusions are hexagonal shaped.

In Example 6, the anti-slip strap of any of the preceding Examples, wherein the first and the second set of protrusions comprise cloth.

In Example 7, the anti-slip strap of any of the preceding Examples, wherein the first set of protrusions is coupled to a first elongated strip, wherein the second set of protrusions is coupled to a second elongated strip.

In Example 8, the anti-slip strap of any of the preceding Examples, wherein the first and the second set of protrusions comprise a plurality of loops.

In Example 9, the anti-slip strap of any of the preceding Examples, further comprising a stretchable band coupled to the base strap.

In Example 10, the anti-slip strap of any of the preceding Examples, further comprising a latch including a first latch portion and a second latch portion configured to be removably coupled to each other.

In Example 11, the anti-slip strap of Example 10, wherein the first latch portion is coupled to one end of the base strap.

In Example 12, the anti-slip strap of Example 11, wherein the second latch portion is coupled to the base strap such that the second latch portion is slidable with respect to the base strap.

In Example 13, footwear including a shoe including an upper and a sole with a heel portion and a forefoot portion. The footwear further includes an anti-slip strap removably coupled to the shoe. The anti-slip strap includes a base strap comprising woven synthetic fibers, a first set of protrusions coupled to and positioned along a first section of the base strap and spaced from each other to create a first set of channels therethrough, and a second set of protrusions coupled to and positioned along a second section of the base strap and spaced from each other to create a second set of channels therethrough.

In Example 14, the footwear of Example 13, wherein the first section of the base strap at least partially covers the heel section, wherein the second section of the base strap at least partially covers the forefoot portion.

In Example 15, the footwear of Examples 13 and 14, wherein the base strap is wrapped around the upper and the sole of the shoe.

In Example 16, the footwear of Examples 13-15, wherein the shoe has an elongated direction, wherein the first section and the second section extend lengthwise perpendicular to the elongated direction and widthwise parallel to the elongated direction.

In Example 17, the footwear of Examples 13-16, wherein the anti-slip strap includes a stretchable band coupled to the base strap such that the stretchable band at least partially covers the upper of the shoe.

In Example 18, the footwear of Examples 13-17, wherein the first and the second set of protrusions are stitched to the base strap.

In Example 19, the footwear of Examples 13-17, wherein the first set of protrusions are spaced from the second set of protrusions without any other protrusions spaced therebetween.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
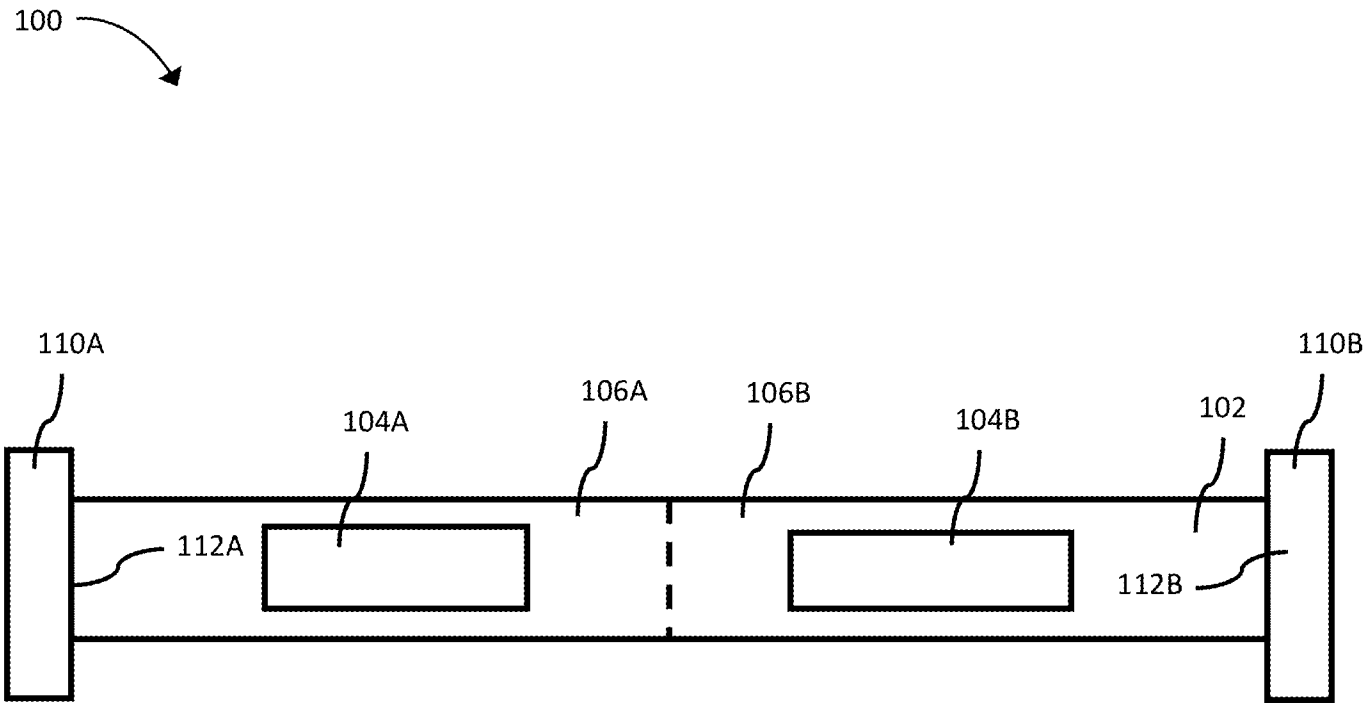
FIG. 1 shows a bottom view of an anti-slip strap, in accordance with certain embodiments of the present disclosure.

While the disclosure is amenable to various modifications and alternative forms, specific embodiments have been shown by way of example in the drawings and are described in detail below. The intention, however, is not to limit the disclosure to the particular embodiments described but instead is intended to cover all modifications, equivalents, and alternatives falling within the scope of the appended claims.

DETAILED DESCRIPTION

Workers in the restaurant industry are sometimes required to purchase slip-resistant shoes. These shoes have soles that may include certain materials and tread patterns that are intended to help resist sliding with respect to, for example, a floor with grease or other liquids created in the course of preparing food. However, these shoes can be expensive, uncomfortable, bulky, and not very effective after one or more uses.

Certain embodiments of the present disclosure are accordingly directed to slip-resistant straps that can be removably coupled to footwear. The slip-resistant straps can be adjusted to fit a variety of shoe sizes and shapes, and so the slip-resistant straps can be used with normal shoes (e.g., shoes not designed to be slip resistant) without needing to purchase separate slip-resistance shoes. Further, the slip-resistant straps can be removed, washed to maintain their effectiveness in resisting slipping on floors, and placed back on a person's shoes.

FIG. 1 shows a bottom view of a schematic of a slip-resistant strap 100 (hereinafter referred to as "the strap 100"). The strap 100 includes a base strap 102 (hereinafter referred to as "the base 102"), which can be made of various materials. In certain embodiments, the base 102 comprises woven synthetic fibers such as fibers referred to as nylon. In other embodiments, the base 102 comprises a band comprised of rubber (e.g., neoprene rubber foam) which is shown in more detail in FIGS. 6 and 7.

The strap 100 further includes a first set of protrusions 104A or protrusion elements and a second set of protrusions 104B or protrusion elements. Both the first and second set of protrusions 104A and 104B are coupled to the base 102. In certain embodiments, the first and second set of protrusions 104A and 104B are stitched (e.g., sewed) to the base 102. Additionally or alternatively, the first and second set of protrusions 104A and 104B are adhered (e.g., glued) to the base 102. The first and second set of protrusions 104A and 104B can be coupled to the same, single side of the base 102.

As shown in FIG. 1, the first and second set of protrusions 104A and 104B are separated or spaced from each other along the length of the base 102. In certain embodiments, the first and second set of protrusions 104A and 104B are spaced from each other lengthwise along the base 102 such that no other protrusions are positioned between the two sets. The first set of protrusions 104A can be considered to be positioned along a first section 106A of the base 102, and the second set of protrusions 1046 can be considered to be positioned along a second section 1066 of the base 102.

The strap 100 can include a latch 108 with a first latch portion 110A and a second latch portion 1106, which are configured to be removably coupled to each other. For example, the first latch portion 110A can be inserted into the second latch portion 1106, or vice versa, to connect to each other. The latch 108 can function similar to a seatbelt buckle, backpack buckle, and the like. The first latch portion 110A can be secured to one of the ends 112A and 112B of the base 102. For example, the first latch portion 110A can be stitched or otherwise attached to the one of the ends 112A or 1126 of the base 102. The second latch portion 1106 can be coupled to the base 102 such that the second latch portion 1106 is slidable with respect to the base 102. For example, the second latch portion 1106 can include one or more openings through which the base 102 is threaded or otherwise inserted through. As will be discussed in more detail below, the strap 100 can adjusted for different shoe sizes and shapes by adjusting the position of the base 102 with respect to the latch 108.

Additionally or alternatively to the latch 108, in certain embodiments, the strap 100 includes a stretchable band (e.g., a rubber band) that is coupled to the base 102 to help secure the strap 100 to shoes with different sizes and shapes. In embodiments where the base 102 includes a band comprised of rubber, the strap 100 may not include the latch 108. Instead, the strap 100 may be loop-shaped and stretched over a user's shoes to fit and couple the strap 100 to the shoes.

Figure 2:
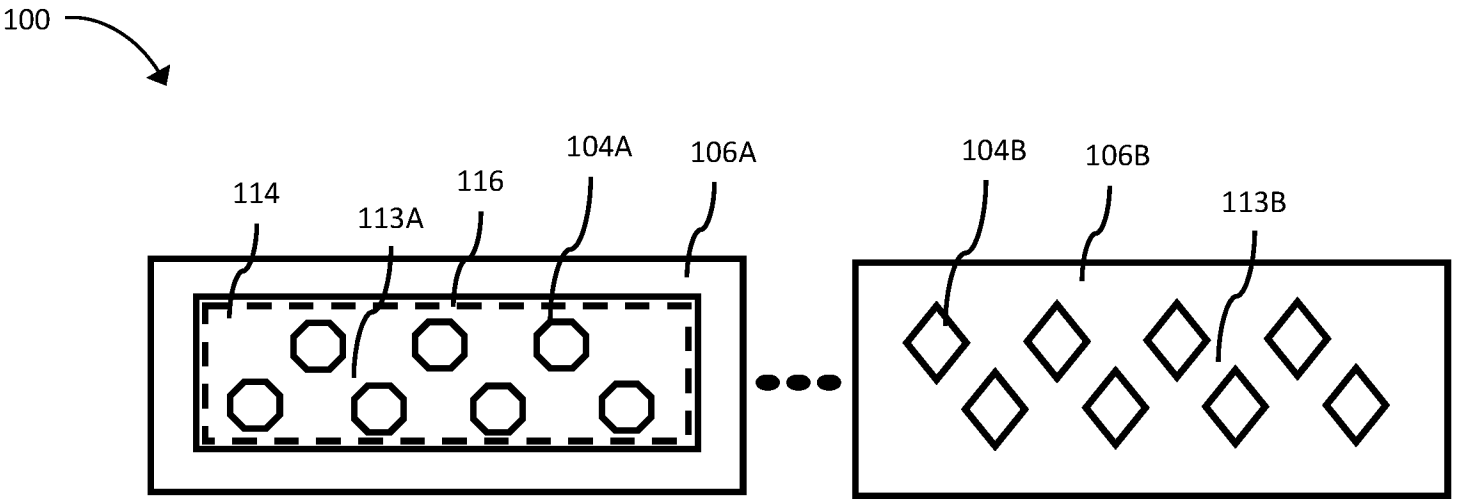
FIG. 2 shows a top view of portions of the anti-slip strap of FIG. 1, in accordance with certain embodiments of the present disclosure.
Figure 3:
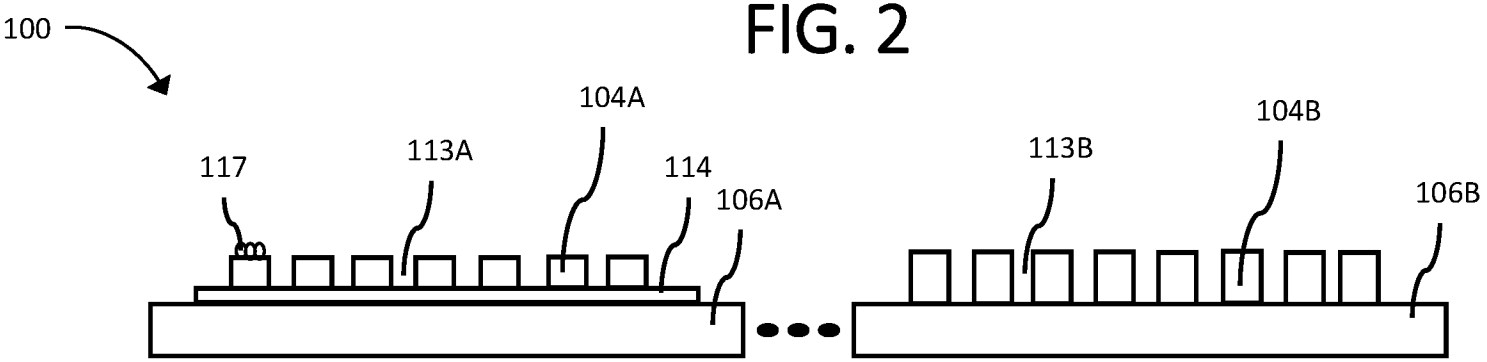
FIG. 3 shows a side view of portions of the anti-slip strap of FIG. 1, in accordance with certain embodiments of the present disclosure.

FIG. 2 shows a top view of portions of the strap 100, and FIG. 3 shows a side view of portions of the strap 100. In FIGS. 2 and 3, to show different potential arrangements and shapes in one set of figures, the first set of protrusions 104A along the first section 106A of the base 102 are shown as being differently shaped than the second set of protrusions 104B along the second section 106A of the base 102. However, it should be appreciated that the first set of protrusions 104A and the second set of protrusions 104B can have similar or the same arrangements and shapes.

The first set of protrusions 104A are shown as having a hexagonal shape, and the second set of protrusions 1046 are shown as having a diamond or square shape.

The first set of protrusions 104A are shown as having a hexagonal shape, and the second set of protrusions 104B are shown as having a diamond or square shape. In other embodiments, the first and second set of protrusions 104A and 104B are circle shaped, rectangular shaped, and the like. The first of protrusions 104A are spaced from each other to create a first set of channels 113A, and the second of protrusions 104B are spaced from each other to create a second set of channels 113B. The first and second channels 113A and 113B extend between the respective first and second set of protrusions 104A and 104B. When the strap 100 is secured to a shoe, the first and second channels 113A and 113B allow for liquids to pass through the channels and away from underneath the shoe. Although only two rows of protrusions are shown in FIG. 2, the first and second set of protrusions 104A and 104B can include additional rows (e.g., three rows, four rows, five rows as space permits). Further, the first and second set of protrusions 104A and 104B can be arranged on the base 102 such that the first and second set of protrusions 104A and 104B are not aligned in rows, and instead, may be more randomly arranged or arranged in columns that are offset from each other and not necessarily aligned in rows.

In FIGS. 2 and 3, the first set of protrusions 104A are shown as being positioned along a strip 114 of material that is stitched (e.g., via stitches 116 shown in FIG. 2) to the base 102. The first set of protrusions 104B (and, in embodiments, the second set of protrusions 104B too) can be part of or coupled to the strip 114 before the strip 114 is stitched to the base 102. For example, it may be easier to manufacture the first set of protrusions 104A and the strip 114 together before being coupled to the base 102. In certain embodiments, the strip 114 and the first set of protrusions 104A are integrally formed of the same material. In certain embodiments, the first and second set of protrusions 104A and 104B are comprised of a cloth material (e.g., a terry cloth comprising cotton). In some embodiments, the first and second set of protrusions 104A and 104B include a plurality of loops 117 (e.g., small Velcro-like loops). In other embodiments, the first set of protrusions 104A and the second set of protrusions 104B are attached (e.g., stitched) directly to the base 102.

Figure 4:
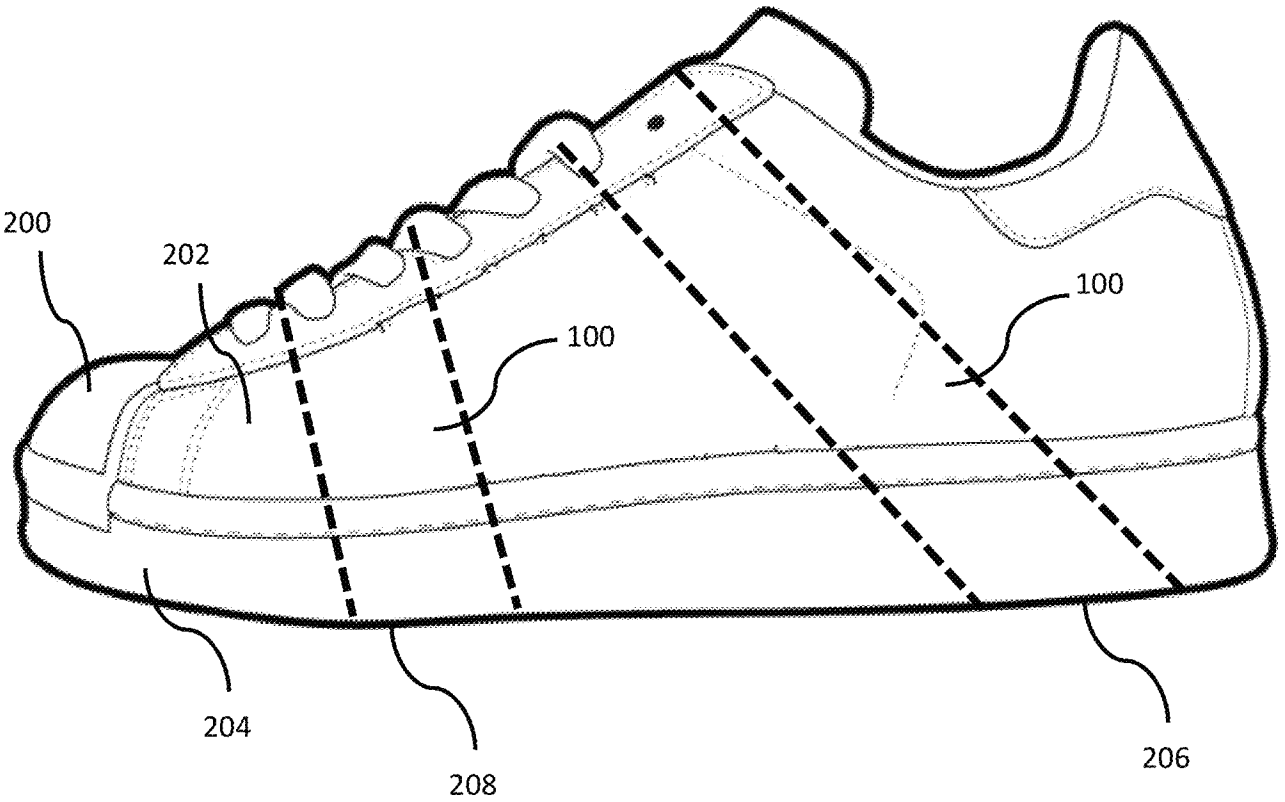
FIG. 4 shows a bottom view of a shoe with the anti-slip strap of FIGS. 1-3 attached, in accordance with certain embodiments of the present disclosure.
Figure 5:
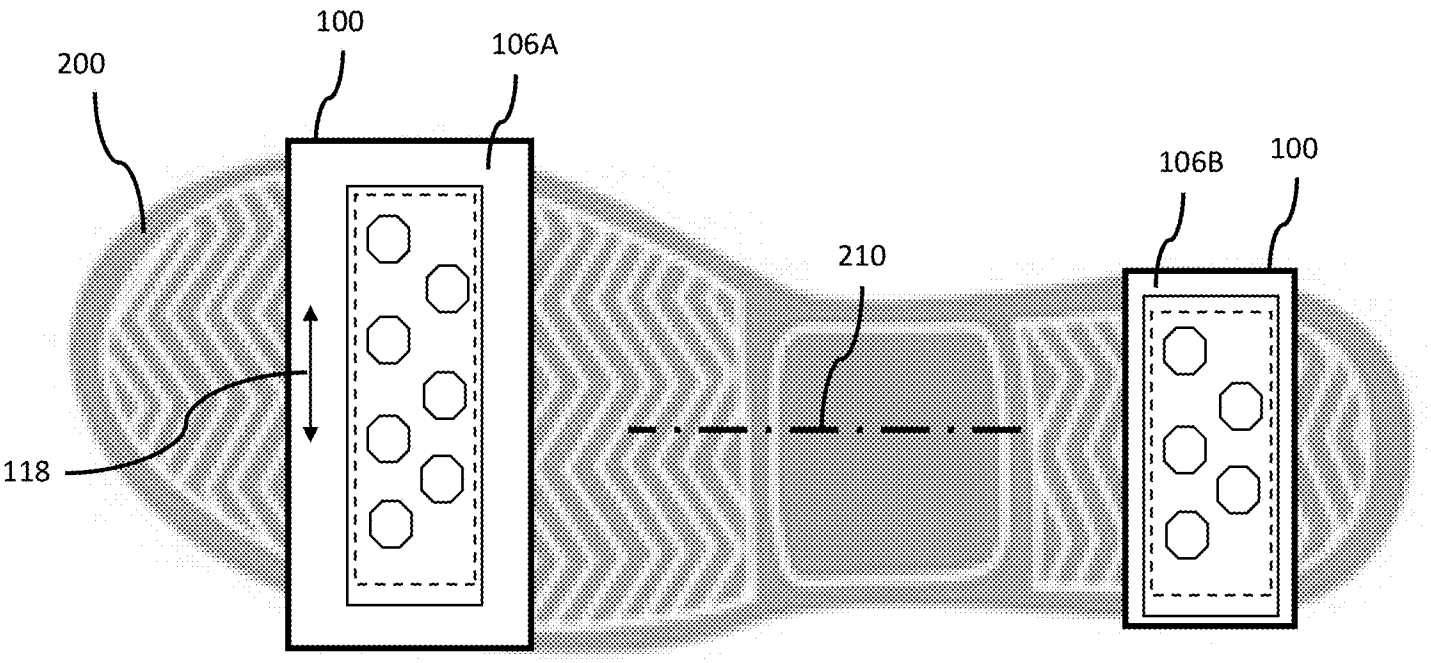
FIG. 5 shows a side view of the shoe and anti-slip strap of FIG. 4, in accordance with certain embodiments of the present disclosure.

FIGS. 4 and 5 show examples of how the strap can be positioned on footwear 200 (e.g., a shoe). The outline of the strap 100 is shown in dotted lines to differentiate it from parts of the footwear 200. The footwear 200 includes an upper section 202 and a sole 204, which includes a heel portion 206 and a forefront portion 208.

The strap 100 can be completely wrapped around the footwear 200 such that the strap 100 at least partially covers both the upper section 202 and the sole 204. In certain embodiments, the strap 100 is wrapped around the footwear 200 or strapped to the footwear such that the first set of protrusions 104A along the first section 106A of the base 102 at least partially covers the heel portion 206 and the second set of protrusions 1046 along the second section 106A of the base 102 at least partially covers the forefront portion 208. The strap 100 can be wrapped such that the first section 106A and the second section 1066 extend lengthwise 118 in a direction that is perpendicular to an elongated direction 210 of the footwear 200.

The strap 100 and its first set of protrusions 104A and the second set of protrusions 104B can be positioned between the sole 204 and a floor along areas where the user's body weight is distributed most (e.g., along the heels of the feet and the forefronts of the feet). As the user walks across a wet of greasy floor, the first set of protrusions 104A and the second set of protrusions 104B help act as anti-slip components. For example, grease on the floor can be forced out between the channels 113A and 113B of the strap 100 so that the first set of protrusions 104A and the second set of protrusions 104 can contact the floor.

As previously mentioned, the first set of protrusions 104A and the second set of protrusions 104 can comprise slip-resistant materials that help provide friction between the strap 100 and the floor. Further, the strap 100 can be removed from the footwear 200 after used and separately washed to clean off residue before being used again.

Figure 6:
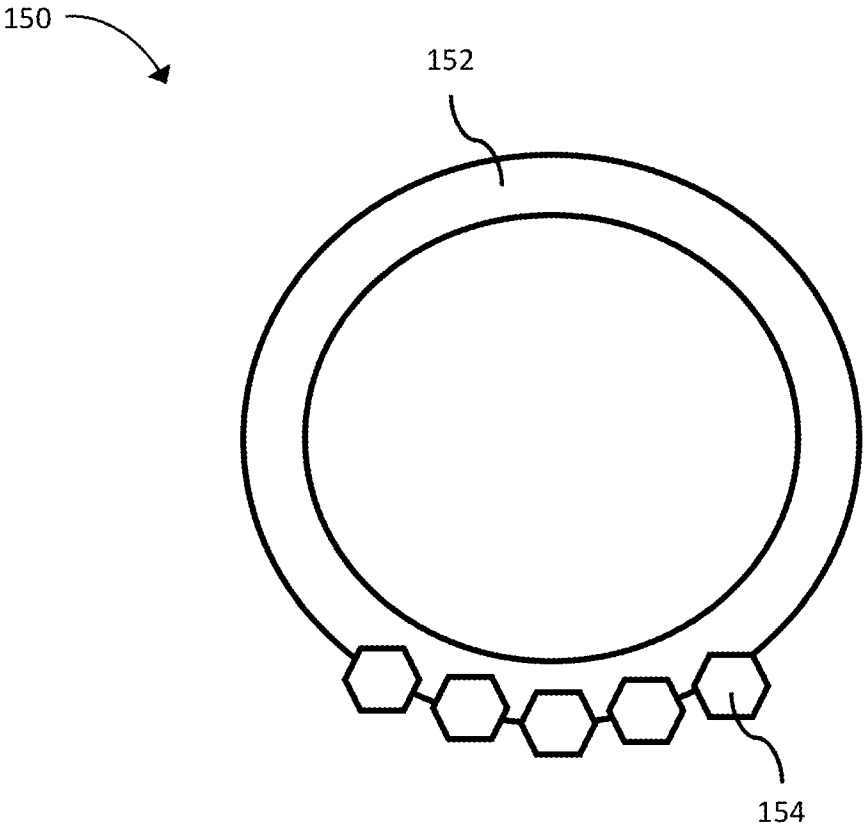
FIG. 6 shows a top view of an anti-slip strap without separate latches, in accordance with certain embodiments of the present disclosure.
Figure 7:
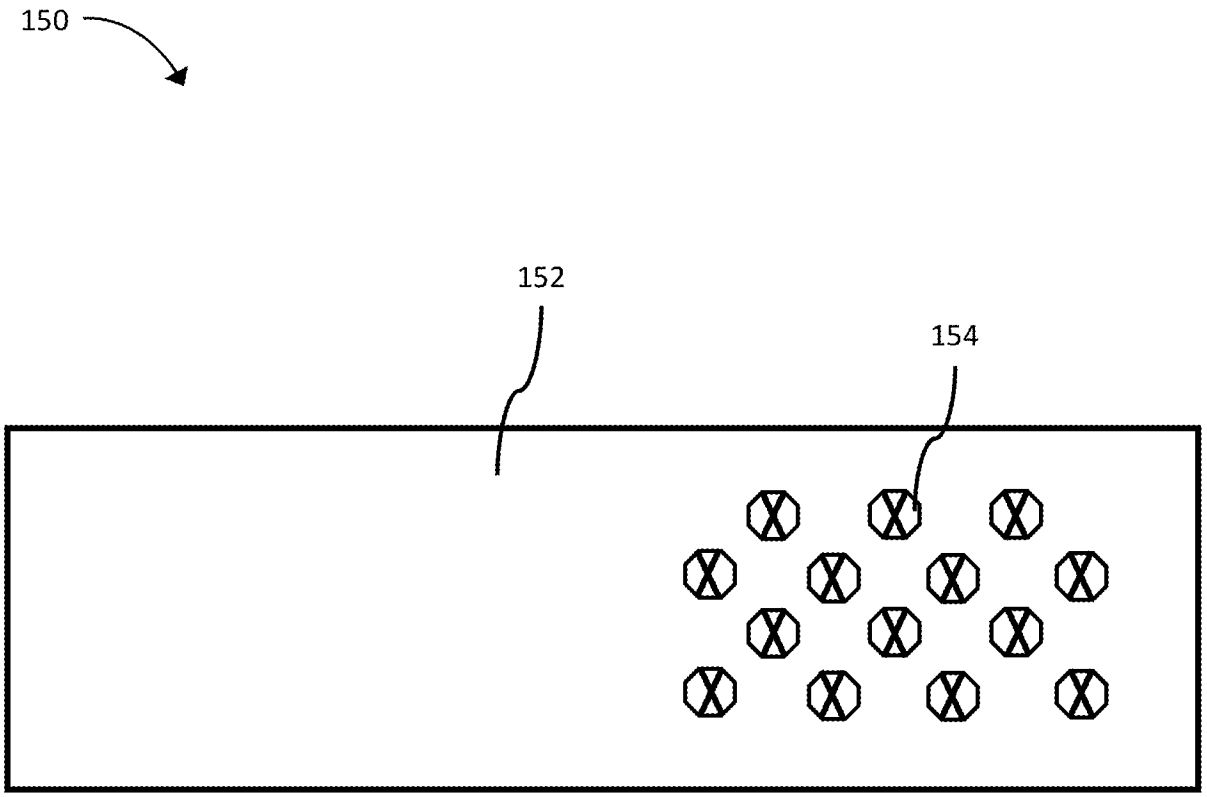
FIG. 7 shows the anti-slip strap of FIG. 6 in ribbon form, in accordance with certain embodiments of the present disclosure.

FIGS. 6 and 7 show an anti-slip strap 150 (hereinafter the "strap 150") that includes a base strap 152 (hereinafter the "base 152") that is a cylinder-shaped band. The base 152 can comprise an elastic material (e.g., a silicone rubber material) that can be stretched over a user's shoes.

The strap 150 can include anti-slip components such as a pattern of protrusions 154 (e.g., 10-20 protrusions such as 15 protrusions in a uniform arrangement) that extend from the base 152. The protrusions 154 can be embossed into the base 152 and can also comprise an elastic material such as a silicone rubber material. The protrusions 154 are shown as being hexagonal shaped, which may be preferred, but can be other shapes as described above. Channels or grooves can extend between the protrusions 154. In certain embodiments, the protrusions 154 cover 50-90% (e.g., 55%, 65%, 75%, 85%) of the base 152 that is positioned underneath a user's shoe. In certain embodiments, the protrusions 154 themselves include one or more channels or cuts on the bottom face of the protrusions 154 (e.g., the face that contacts a floor). The channels or cuts can help facilitate grease or oil flowing away from the bottom faces of the protrusions 154.

In certain embodiments, the base 152 is approximately 190 mm long (if unrolled into a ribbon or in circumference), approximately 50 mm wide, and approximately 1.2 mm thick. In certain embodiments, the protrusions 154 are less than 1 mm in height (e.g., 0.1 mm, 0.2 mm, 0.3 mm).

Various modifications and additions can be made to the embodiments disclosed without departing from the scope of this disclosure. For example, while the embodiments described above refer to particular features, the scope of this disclosure also includes embodiments having different combinations of features and embodiments that do not include all of the described features. Accordingly, the scope of the present disclosure is intended to include all such alternatives, modifications, and variations as falling within the scope of the claims, together with all equivalents thereof.

I claim:

1. An anti-slip strap for removably coupling and at least partially covering a shoe, the anti-slip strap comprising: a base strap comprising woven synthetic fibers, having a first end and a second end, and forming a single strip extending between the first end and the second end; a first set of protrusions coupled to the base strap and spaced from each other to create a first set of channels therethrough; and a second set of protrusions coupled to the base strap and spaced from each other to create a second set of channels therethrough, wherein, when coupled to the shoe, the single strip is configured to be wrapped around the shoe multiple times such that (1) the first set of protrusions are positioned along a heel portion of the shoe and (2) the second set of protrusions are positioned along a forefoot portion of the shoe when the base strap is coupled to the shoe; and wherein the first and the second set of protrusions comprise cloth.

2. The anti-slip strap of claim 1, wherein the first and the second set of protrusions are stitched to the base strap.

3. The anti-slip strap of claim 1, wherein the first set of protrusions are spaced from the second set of protrusions without any other protrusions spaced therebetween.

4. The anti-slip strap of claim 1, wherein the first and the second set of protrusions are coupled to the base strap on the same side of the base strap.

5. The anti-slip strap of claim 1, wherein the first and the second set of protrusions are hexagonal shaped.

6. The anti-slip strap of claim 1, wherein the first and the second set of protrusions comprise a plurality of loops.

7. The anti-slip strap of claim 1, further comprising:

a latch including a first latch portion and a second latch portion configured to be removably coupled to each other.

8. The anti-slip strap of claim 7, wherein the first latch portion is coupled to the first end.

9. The anti-slip strap of claim 8, wherein the second latch portion is coupled to the base strap such that the second latch portion is slidable with respect to the base strap.

10. A footwear comprising:

a shoe including an upper and a sole with a heel portion and a forefoot portion; and an anti-slip strap removably coupled to the shoe, the anti-slip strap including:

a base strap comprising woven synthetic fibers, having a first end and a second end, and forming a single strip extending between the first end and the second end, a first set of protrusions coupled to and positioned along a first section of the base strap and spaced from each other to create a first set of channels therethrough, and a second set of protrusions coupled to and positioned along a second section of the base strap and spaced from each other to create a second set of channels therethrough, wherein the single strip is wrapped around the shoe multiple times such that (1) the first set of protrusions are positioned along the heel portion and (2) the second set of protrusions are positioned along the forefoot portion.

11. The footwear of claim 10, wherein the single strip is wrapped around the upper and the sole of the shoe.

12. The footwear of claim 10, wherein the shoe has an elongated direction, wherein the first section and the second section extend lengthwise perpendicular to the elongated direction and widthwise parallel to the elongated direction.

13. The footwear of claim 10, wherein the first and the second set of protrusions are stitched to the base strap.

14. The footwear of claim 10, wherein the first set of protrusions are spaced from the second set of protrusions without any other protrusions spaced therebetween.

* * * * *